United States Patent [19]

Schriber

[11] 3,959,687

[45] May 25, 1976

[54] INTERCOUPLED LINEAR ACCELERATOR SECTIONS OPERATING IN THE $2\pi/3$ MODE

[75] Inventor: Stanley O. Schriber, Deep River, Canada

[73] Assignee: Atomic Energy of Canada Limited, Ottawa, Canada

[22] Filed: Mar. 3, 1975

[21] Appl. No.: 555,045

[30] Foreign Application Priority Data

Aug. 1, 1974 Canada ..... 206112

[52] U.S. Cl. ..... 315/5.42; 315/3.6; 328/233; 315/5.41

[51] Int. Cl.[2] ..... H01J 25/10

[58] Field of Search ..... 315/5.41, 5.42, 3.6; 313/63; 328/233

[56] References Cited

UNITED STATES PATENTS

| | | | |
|---|---|---|---|
| 2,556,978 | 6/1951 | Pierce | 315/5.41 |
| 2,925,522 | 2/1960 | Kelliher | 315/3.6 X |
| 3,068,425 | 12/1962 | Le Boutet et al. | 315/3.6 X |
| 3,133,227 | 5/1964 | Brown et al. | 315/3.6 X |
| 3,546,524 | 12/1970 | Stark | 315/5.41 |

*Primary Examiner*—Saxfield Chatmon, Jr.
*Attorney, Agent, or Firm*—Edward Rymek

[57] ABSTRACT

In the $2\pi/3$ standing wave mode of energizing resonant cavities, a regular field pattern is set up between adjacent cavities which follows the sequence + (or −), − (or +) and zero. In the novel system of this invention, two series of cavities are used to form accelerating sections wherein the standing wave is propagated successively from one section to the other such that adjacent cavities in each of the sections have positive and negative fields and the resonant coupling cells between the sections have zero fields. This system is used in the acceleration of two beams by a single driving source or in a double track race-track microtron.

10 Claims, 5 Drawing Figures

INTERCOUPLED LINEAR ACCELERATOR SECTIONS OPERATING IN THE $2\pi/3$ MODE

This invention relates to linear accelerators and in particular to linear accelerators operating in the $2\pi/3$ mode.

Conventional single-path standing-wave linear accelerators usually are operated in the $\pi/2$ mode due to their stability, tolerances, etc. However, where space is a limitation and high particle energy is a requirement, $\pi/2$ mode accelerators and in particular race-track microtrons, whether single or double track, are found to have disadvantages since a $\pi/2$ mode accelerator section requires double the number of coupling cavities as compared with a $2\pi/3$ mode accelerator section. In addition, for two or more coupled accelerating sections of the $\pi/2$ or $2\pi/3$ type, elaborate coupling arrangements are required for the r.f. drive which increased both the cost and space requirements for the system.

It is therefore an object of this invention to provide an improved coupling arrangement between $2\pi/3$ accelerator sections.

It is a further object of this invention to provide parallel intercoupled 2 $\pi/3$ accelerator sections driven by a single source.

It is another object of this invention to provide two parallel intercoupled 2 $\pi/3$ linear accelerators driven by a single source.

It is a further object of this invention to provide a novel $2\pi/3$ double-track race-track microtron.

These and other objects are generally achieved in a linear accelerator system having N resonant cells, where $N = 3l\ 2$ with $l$ an integer, $l = 1,2,3, \ldots$, $(N + 1)/3$ of the cells form a first linear accelerating section wherein successive pairs of cells are energy coupled by means of coupling slots in their common wall. In addition, all of these resonant cells have aligned beam holes allowing a particle beam to pass through the linear accelerating section. A second series of $(N + 1)/3$ of the cells form a second linear accelerating section which is identical to the first. The remaining $$\frac{N+1}{3} - 1$$

resonant cells couple even numbered cells in the first section to odd numbered cells in the second section and odd numbered cells in the first section to even numbered cells in the second section. A drive source is connected to one of the resonant cells in the first or second section and energizes the entire system in the $2\pi/3$ mode whereby the successive resonant cells in the accelerating sections are alternately positive and negative and the coupling resonant cells have a zero field.

This system provides dual accelerator paths which may be used to accelerate two particle beams under identical conditions.

It may also be adapted to a double track race-track microtron wherein a single beam is accelerated through the first section, turned around and accelerated through the second section. If high energy particles are desired, several passes may be made through each of the two accelerating sections. In the drawings.

In the standing wave mode of energizing a linear accelerator section with full cell termination, the $E_n$ fields in the individual cells of section may be represented by the equation:

$$E_n = \sin\left(\frac{n\pi q}{N+1}\right)$$

where $n$ = cell number (integer — 1, 2, 3 . . . )

$q$ = mode number (integer — 1, 2, 3 . . . )

N = total number of cells in the system (integer — 1, 2, 3 . . .)

For the $2\pi/3$ standing wave mode of operation, the following relationship must therefore exist:

$$\frac{\pi q}{N+1} = 2\pi/3$$

Figure 1:
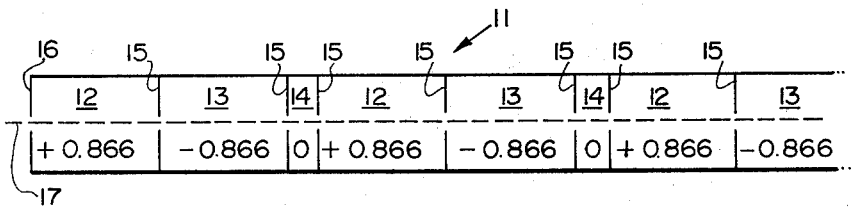
FIG. 1 represents a $2\pi/3$ mode accelerating section with pancake coupling.
Figure 2:
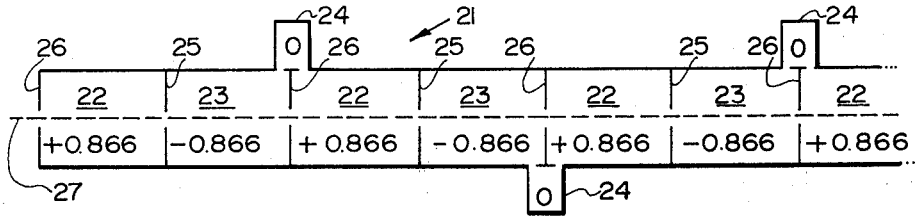
FIG. 2 represents a $2\pi/3$ mode accelerating section with side coupling.

From the above, for full cell termination, various accelerator sections have been developed, two of which are schematically shown in FIGS. 1 and 2. In FIG. 1, a cell arrangement is shown wherein at a particular instant in time the accelerator section 11 has a first, fourth, seventh etc. resonant cell 12 with a positive field, a second, fifth, eight, etc. resonant cell 13 with a negative field, and a third, sixth, etc. cell 14 with a zero field. The walls 15 between the cells and the end wall 16 have aligned beam holes allowing the particle beam 17 to move through the accelerator section 11. In addition, walls 15 include means for coupling r.f. energy from one cell to the next, such as coupling slots, loops or other conventional means.

Since resonant cells 14 do not add energy to the particle beam 17, and merely act as a coupling cell between cells 13 and 12, they may be positioned completely to one side of the beam path. This development is shown schematically in FIG. 2 wherein the accelerator section 21, at a particular instant in time, has a first, fourth, seventh, tenth, etc. resonant cell 22 with a positive field, a second, fifth, eighth, etc. resonant cell 23 with a negative field, and a third, sixth etc. cell 24 which has a zero field and is positioned completely to one side of the beam 27 path to provide coupling between cells 23 and 22. The walls 25 and 26 include aligned beam holes, allowing the particle beam to move through the accelerator section 21. In addition, walls 25 include coupling slots to provide energy coupling between the adjacent cells 22, 23.

Figure 3:
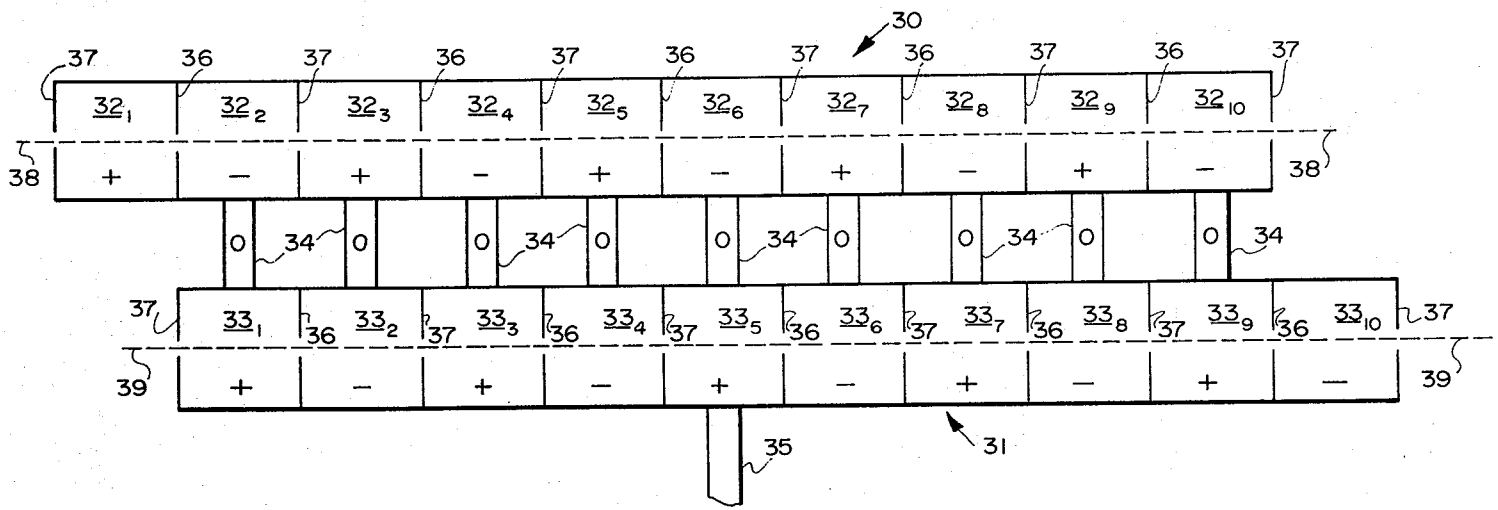
FIG. 3 represents $2\pi/3$ mode accelerating sections coupled in accordance with this invention.

FIG. 3, in schematic form, represents parallel accelerator sections 30, 31, which are intercoupled in accordance with this invention. Each accelerator section 30 and 31 includes a series of resonant cells $32_{1 \ldots 10}$ and $33_{1 \ldots 10}$ respectively having common walls with adjacent cells. A number of resonant coupling cells 34 interconnect the cells in section 30 with the cells in section 31 to couple the standing wave energy between the two sections. The entire assembly is driven by an r.f. source which is coupled to one of the resonant cells 32 or 33 by means of a waveguide 35. The walls 36 between successive adjacent pairs of cells include energy coupling means such as coupling slots to couple energy between these cells, whereas walls 37 are solid. Walls 36 and 37 further include beam holes which are aligned to allow a particle beam 38 to pass through accelerator section 30 and a beam 39 to pass through accelerator section 31.

In operation, the parallel accelerator sections are operated in the $2\pi/3$ standing wave mode by means of an r.f. source coupled thereto at a single point. Independent of which section 30 or 31 the r.f. source is coupled, both sections 30 and 31 are excited via the coupling cells 34. At an instant in time, adjacent resonant cells 32 or 33 have a negative or positive field as indicated by + or − in FIG. 3 for efficient particle acceleration while the coupling cells 34 always have a 0 field.

Figure 4:
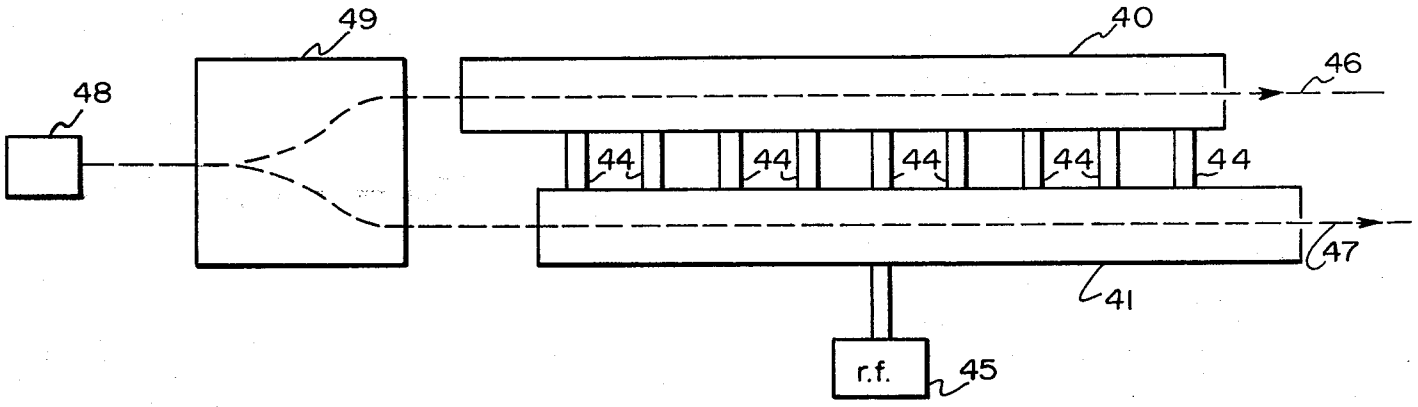
FIG. 4 represents a dual accelerator with coupling in accordance with this invention.
Figure 5:
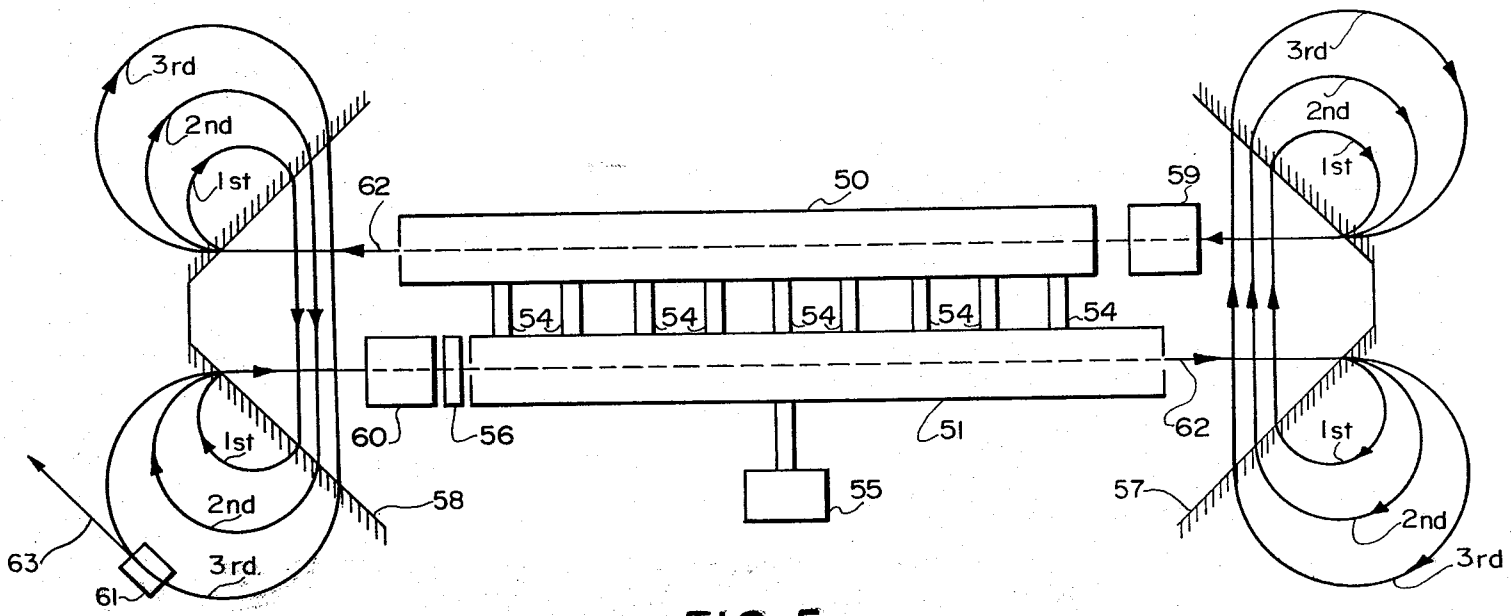
FIG. 5 represents a novel double race-track microtron with coupling in accordance with this invention.

This novel arrangement which provides a number of efficiencies both in terms of component construction and space, may be used in various types of accelerators, some of which are shown in FIGS. 4 and 5.

In FIG. 4, a dual accelerator is shown having a first accelerating section 40 and a second accelerating section 41 which are interconnected by coupling cells 44. The system is driven in the $2\pi/3$ by a single r.f. source 45 and two particle beams 46 and 47 are therefore simultaneously and individually accelerated under what appears to be a $\pi$ standing wave field condition in each section. The particle beams may be generated by two separate beam sources, or as shown in FIG. 4, a single source 48 provides a particle beam which, by means of a magnet system 49, is divided into positive and negative ion beams.

A second type of accelerator to which this invention is particularly applicable is the double track race-track microtron shown in FIG. 5. The microtron includes parallel accelerating sections 50 and 51 interconnected by coupling cells 54 and energized by r.f. source 55. The particle beam 62 is generated by a source 56 and injected into accelerating section 51. An annular source 56 may be mounted about the beam path for direct particle injection. A magnet carriage 57, 58 is located at each end of the accelerating sections. Bending magnets 57 receive the beam 62 as it exits accelerating section 51, bend it through 180° and inject it into accelerating section 50. Bending magnets 58 receive the beam 62 as it exits accelerating section 50, bend it through net 180° and reinject it into accelerating section 51. The beam 62 may make several passes through each accelerating section 50, 51 as indicated by the first, second and third paths in the bending magnets. Bending magnets 57, 58 may consist of a pair of 270° or any other conventional bending magnets which will bend the beam 180°.

The beam is in phase for injection into accelerating section 50 and 51 by adjusting the beam path length between these sections and the bending magnet systems 57 and 58 respectively. This may be done by adjusting the distance between the magnets and the accelerating sections, by adjusting the magnetic fields, and/or by means of steering magnet systems 59 and 60. The beam may be ejected from any of four different locations at the extreme ends of the 270° bends. One such location is shown in FIG. 5 as 61 with the ejected beam labelled 63. To achieve resonance one must ensure that the usual microtron conditions are met by having the energy gain per orbit correct. Assuming relativistic electrons and assuming all magnets have the same magnetic field B is gauss, this resonance condition is met for FIG. 5 if the momentum change per complete orbit is given by approximately $$\Delta p = \frac{n\,B\lambda}{(3\pi + 2)}$$

where $\lambda$ is the r.f. wavelength in cm, $\Delta p$ is the momentum change in gauss-cm. and n is an integer. In a typical magnets system, typical values are $n = 5$, $\lambda = 10$ cm, $B = 10$kG giving $\Delta p = 43{,}760$ gauss-cm or $\Delta E$ (energy gain per orbit) ~12.6 MeV.

The invention has been described using an embodiment in which the accelerating sections use full cell termination. For half cell termination, the fields in each cell are represented by $$E_N = \cos\left[\frac{(n-1)\,\pi\,(q-1)}{N-1}\right] \qquad (2)$$

For a $2\pi/3$ standing wave mode of operation, the following relationship must therefore exist:

$$\frac{2\pi}{3} = \frac{\pi\,(q-1)}{N-1}$$

It has been found that the invention may be adapted to half cell termination for certain mode numbers $q$. However, though the excited mode will have a somewhat similar field distribution, the field in the coupling cavities between the accelerating sections will not be zero.

The invention may also be implemented for an accelerator excited in the $\pi/3$ standing wave mode. However, it has been found that excitation in this mode is not as efficient. In addition, longer drift spaces are required between adjacent cells in each of the accelerating sections which may require other coupling arrangements between cells to propagate the fields.

Finally, double track microtrons may be implemented in the $\pi/2$ mode of operation wherein two or more accelerating sections are excited by a single rf drive connected to a bridge coupler which in turn is coupled to each of the accelerating sections via coupling cells. For the $\pi/2$ mode, the accelerating sections are not interconnected other than through the bridge coupler.

I claim:

1. A linear accelerator system having N resonant cells energized in a standing wave mode comprising:

a first series of (N + 1)/3 successively positioned resonant cells forming a first linear accelerating section, wherein successive pairs of said first resonant cells have energy coupling slots and said first resonant cells having beam holes aligned along a first axis;

a second series of (N + 1)/3 successively positioned resonant cells forming a second linear accelerating section wherein successive pairs of said second resonant cells have energy coupling slots and said second resonant cells having beam holes, aligned along a second axis;

[(N + 1/3]− 1 resonant coupling cells for coupling energy between the even numbered resonant cells in said first accelerating section and the odd numbered cells in said second accelerating section, and for coupling energy between the odd numbered cells in said first accelerating section and the even numbered cells in said second accelerating section; and source means coupled to one of said resonant cells to excite said system in a standing wave mode.

2. A linear accelerator system as claimed in claim 1 which further includes beam means adapted to inject a first particle beam into said first accelerating section and a second particle beam into said second accelerating section.

3. A linear accelerator system as claimed in claim 2 wherein said beam means comprises:

means adapted to generate a particle beam and means adapted to split said particle beam to provide said first particle beam and said second particle beam.

4. A linear accelerator system as claimed in claim 1 which further includes:

means adapted to generate a particle beam and inject said beam into said first accelerating section; and first bending magnet means adapted to receive the accelerated particle beam leaving said first accelerating section and injecting it into said second acceleration section to further accelerate said particle beam.

5. A linear accelerator system as claimed in claim 4 which further includes second bending magnet means adapted to receive the accelerated particle beam leaving said second accelerating section and reinjecting it into said first accelerating section.

6. A linear accelerator system as claimed in claim 5 which further includes first adjusting means located on the beam path at the entrance of said first accelerating section and second adjusting means located on the beam path at the entrance to said second accelerating section, said first and second adjusting means adapted to adjust said beam path length.

7. A linear accelerator system as claimed in claim 1 in which said source means is adapted to excite said system in the $2\pi/3$ mode.

8. In a linear accelerator system having N resonant cells, a double-track accelerating structure comprising:

a first series of $(N + 1)/3$ successively positioned resonant cells forming a first linear accelerating section, each of said first resonant cells having aligned beam holes to provide (for) a first beam path through said first section, and energy coupling means connected between successive pairs of adjacent cells in said first section;

a second series of $(N + 1)/3$ successively positioned resonant cells forming a second linear accelerating section, each of said second resonant cells having aligned beam holes to provide (for) a second beam path through said second section, and energy coupling means connected between successive pairs of adjacent cells in said second section; and $[(N + 1)/3] - 1$ resonant coupling cells for coupling energy between the (connecting) even numbered cells in said first section and the (to) odd numbered cells in said second section, and for coupling energy between the odd numbered cells in said first section and the (to) even numbered cells in said second section (to couple energy between said first and second accelerating section).

9. A double-track accelerating structure as claimed in claim 8 in which said first and second resonant cells are full cells.

10. A double-track accelerating structure as claimed in claim 8 in which said energy coupling means consists of coupling slots in the walls between said adjacent cells.

* * * * *